United States Patent [19]

Tennent

[11] 4,097,626

[45] Jun. 27, 1978

[54] CONSTRUCTION FOR A FIBER REINFORCED SHAFT

[75] Inventor: Richard Lee Tennent, La Mesa, Calif.

[73] Assignee: Grafalloy Corporation, El Cajon, Calif.

[21] Appl. No.: 693,147

[22] Filed: Jun. 7, 1976

[51] Int. Cl.[2] ..... D02G 3/00; A63B 53/10; B32B 5/12

[52] U.S. Cl. ..... 428/36; 156/188; 156/190; 273/80 R; 273/DIG. 7; 273/DIG. 23; 428/109; 428/112; 428/376; 428/377; 428/902

[58] Field of Search ..... 428/36, 109, 110, 112, 428/114, 376, 377, 902; 156/188, 190; 273/80 R, 80 B, 73 F, DIG. 7, DIG. 23

[56] References Cited

U.S. PATENT DOCUMENTS

| | | | |
|---|---|---|---|
| 2,594,693 | 4/1952 | Smith | 273/DIG. 7 |
| 2,749,643 | 6/1956 | Scott | 273/80 R |
| 3,260,010 | 7/1966 | Dubois | 273/DIG. 7 |
| 3,574,104 | 4/1971 | Medlar | 156/188 |
| 3,896,858 | 7/1975 | Whatley | 273/73 F |
| 3,946,127 | 3/1976 | Eisenmann et al. | 428/109 |
| 3,974,012 | 10/1976 | Hogarth | 428/36 |
| 4,000,896 | 1/1977 | Lauraitis | 273/80 R |
| 4,023,801 | 5/1977 | Van Auken | 428/110 |
| 4,043,074 | 8/1977 | Airhart | 273/DIG. 23 |

FOREIGN PATENT DOCUMENTS

| | | | |
|---|---|---|---|
| 1,261,541 | 1/1972 | United Kingdom | 273/80 R |

*Primary Examiner*—William R. Dixon, Jr.
*Attorney, Agent, or Firm*—Brown & Martin

[57] ABSTRACT

A carbon graphite fiber reinforced shaft incorporating longitudinal plies and radial plies. In transverse aspect, the radial plies incorporate two interleaved helices with three turns around the shaft. The fibers in the two helices are oppositely oriented at an angle to the longitudinal axis of the shaft. The fibers in one radial ply have a modulus that is substantially 50% greater than the modulus of the opposed interleaved radial ply.

6 Claims, 9 Drawing Figures

CONSTRUCTION FOR A FIBER REINFORCED SHAFT

BACKGROUND OF THE INVENTION

Numerous sports implements have been developed incorporating a carbon graphite reinforced structure to take advantage of the high modulus of carbon graphite fibers and the high strength-to-weight ratio of carbon graphite reinforced structures. Many applications such as golf clubs, fishing rods and archery arrows require a generally tubular shaft. Such a shaft must have longitudinal fibers for strength in flex and radial fibers for strength in torsion. According to the prior art, such shafts are normally built up by wrapping laminations of plies of fibers impregnated with uncured epoxy onto a mandrel having the desired shape for the finished product. Generally a ply is of such a length that the ply will wrap around the mandrel and terminate immediately adjacent its starting point. A plurality of laminations are built up in this manner. Some of the plies will have longitudinal fibers and other plies will incorporate fibers at an angle to the longitudinal axis hereinafter referred to as a radial ply. The resulting lay-up is then cured and the mandrel withdrawn to produce a tubular shaft. Manufacturing irregularities result in a relatively high reject rate of shafts at the manufacturing level and in use, an unacceptably large number of shafts thus manufactured become damaged or fail and are returned for refund or exchange.

In its use as a golf club shaft, carbon graphite reinforced typically fails in torsion. Since the head of the golf club is offset from the axis of the shaft, when the club is flexed and especially when the ball is struck, the head end of the shaft is forced to rotate in torsion relative to the hand grip. Such torsion develops radial stresses along the shaft and tends to split the shaft apart. A typical failure is in the longitudinal fiber plies in the epoxy between the fibers. Radial plies are intended to resist torsional deformation and the resultant stress. However, prior art golf club shafts have not had sufficient radial strength to avoid an unacceptably high number of field use failures. Weakness in torsion also causes a large rotational component of the golf club head with a resultant reduction in accuracy and follow through "feel." Extra high modulus graphite fibers are available and if incorporated into the radial plies could provide sufficient strength to resist the torsional deformation of the club head and thereby to reduce the likelihood of failure in the longitudinal plies. However, such high modulus fibers have a very low tensile strength and a very high load rate. When used adjacent to normal modulus fibers, such a high modulus ply tends to absorb all of the torsional load and thereby to fail and split away from the adjacent plies.

Therefore, it is desirable to have a new and improved construction for a golf club shaft with a reduced manufacturing and field rejection rate. Such a shaft is particularly desirable where high modulus fibers may be incorporated in radial plies.

SUMMARY OF THE INVENTION

An exemplary embodiment of the invention overcomes the deficiencies of the prior art devices by incorporating a multi-turn interleaved radial wrap. In the exemplary embodiment, the shaft described is intended for use as a golf club shaft and in particular, is of the type which is referred to as a constant-taper-constant shaft. In such a shaft, the grip portion of the shaft has a constant section which mates with a tapering section and terminates in a constant but smaller diameter section mating with the golf club head. It will be understood that the sections of the shaft requiring additional strength may be built up by additional layers localized to those sections.

Each radial ply is a generally triangular shaped flag of fibers in uncured matrix material. Instead of laying up the radial plies alternately, a sandwich of two or more plies is first assembled, the fibers in each of the plies are oriented so that they will form a substantial angle to the longitudinal axis of the shaft when they are applied to the lay up. The angle must be in excess of 20° from the longitudinal axis to provide substantial radial strength. As will be apparent, if the angle is increased beyond 50°, the longitudinal component will diminish so that sufficient stress may not be transferred to the shaft. However, it has been found that optimum results obtained with an angle of approximately 35°.

The fibers in alternate layers of the sandwich are oppositely oriented. Alternate layers are circumferentially displaced from one another so that in the completed lay up, the terminal portions of each wrap are diametrically opposite on the shaft. As applied to the shaft, the sandwich becomes a three-turn wrap with two and one-half turns of overlap of the alternate layers with their oppositely directed radial fiber orientation. This arrangement results in there being relatively little net difference in the torque resistance to counterclockwise or clockwise rotation. The tendency of torque to cause one of the plies to "open up" is minimized because the alternate ply tends to "tighten up" under the same torque and thereby produces a compressive force holding the opposed ply in position. The resultant long fiber length produces a greater shear plane between the fibers and the epoxy matrix and thereby a greater ability to transfer torsion between layers without splitting. The interlocked relationship of the two sandwich layers makes it possible to utilize high modulus fibers in one of the layers. After the desired torsion strength is built up with the radial plies, longitudinal plies are applied over the lay up.

A completed golf club, incorporating such a shaft, has a much greater torsional resistance to club head rotation and is less likely to fail in torsion. The use of three-turn wraps reduces manufacturing defects and costs and results in a more uniform product. The golf club incorporating such a shaft will produce a truer flight for the golf ball and deliver more of the swing power to the ball. The possibility of such club being damaged by normal use or abuse is also reduced. The relationship of strength versus weight is improved.

Other objects and many attendant advantages of the invention will become more apparent upon a reading of the following detailed description together with the drawings in which like reference numerals refer to like parts throughout and in which:

DETAILED DESCRIPTION OF THE DRAWINGS

Figure 1:
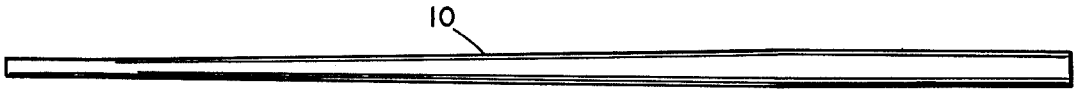
FIG. 1 illustrates a typical shaft incorporating the construction of the invention.
Figure 2:
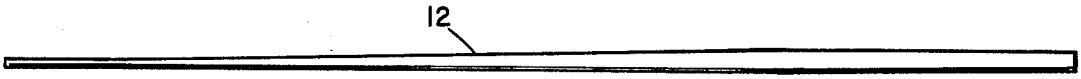
FIG. 2 illustrates the mandrel on which the shaft is layed up.
Figure 3:
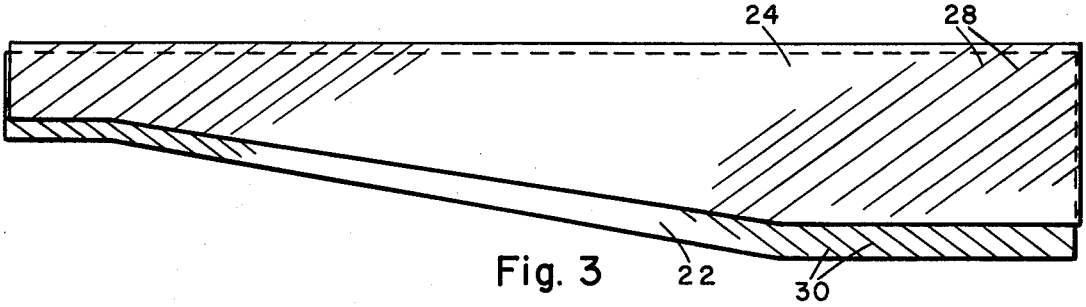
FIG. 3 illustrates a sandwich layered flag with opposite radial angulation for fibers.

Referring to the drawings, radial plies are illustrated in FIG. 3. The inner ply 22 is a generally triangular shaped flag with parallel radial fibers 30 oriented at an angle to the longitudinal axis of the lay up to which they are to be applied. It has been found that an angulation of 35° to the longitudinal axis produces maximum overall strength. Fiber axial orientations in the range of 20° to 50° produce acceptable results. However, contrary to the normal expectations, the 45° orientation is not as strong as a 35° orientation. 35° still has a large percentage of the strength of the fiber in a radial component, but at the same time, the length of the fibers is increased since they extend further along the flag. The increased length of the fibers increases the length of the shear plane, and in conjunction with the use of the three-turn wrap, produces an optimum force transfer relationship between the fibers and the epoxy matrix.

A second layer in the sandwich 24 is applied on top of the layer 22 but is displaced horizontally from the layer 22 by a distance equal to one half the circumference of mandrel 12. The fibers 28 in layer 24 are angled in the opposite direction from fibers 30 in layer 22.

Figure 4:
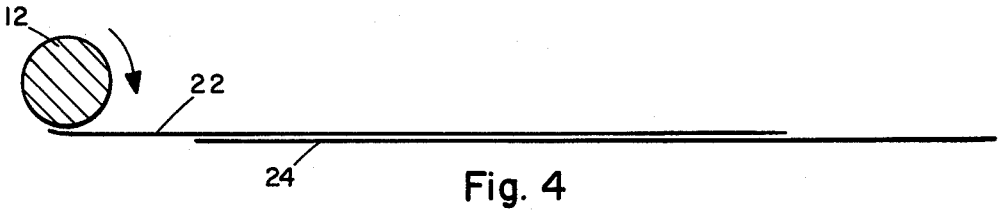
FIG. 4 shows the steps in applying the initial layers of the wrap.
Figure 5:
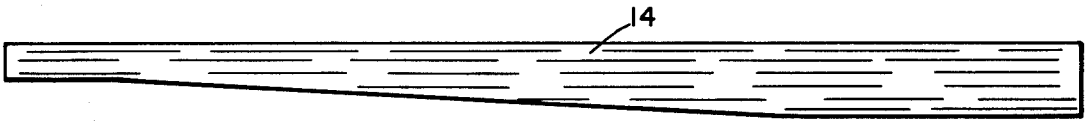
FIG. 5 illustrates a typical flag ply with longitudinal fiber orientation.

FIG. 4 illustrates the application of the radial ply to the mandrel to form the circumferential section 20. The starting point for the ply 22 is oriented diametrically opposite to the terminus of the last longitudinal ply. As the radial ply sandwich is rolled onto the circumferential mandrel 12, the starting point for the ply 24 corresponds to 180° rotation from the starting point to the ply 22. Similarly, when three turns around the lay up have been completed, the terminus of the ply 22 is diametrically opposite its starting point and diametrically opposite the terminus of the ply 24. The appearance in section is that of interleaved wound helices. The completed lay up of the radial plies forms a radial circumferential section 20, as in FIG. 8. Whereas, three turns are preferred, two turns or more will give improved results.

Figure 6A:
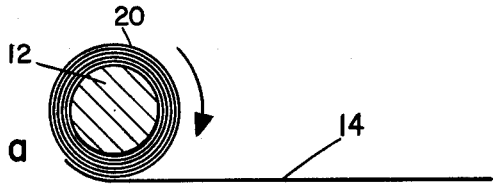
FIG. 6*a* illustrates the start of the outer layer wrap.

The first longitudinal ply is in the form of a generally triangular flag tapering from the constant diameter grip section to a constant diameter club head attachment section. FIG. 6*a* illustrates the application of the flag 14 over the circumferential section 20. The longitudinal and radial plies are comprised of longitudinal fibers in a B-stage epoxy matrix. The epoxy is sufficiently tacky to adhere to the mandrel and to adjacent layers, and sufficiently uncured so that it will readily drape over and attain the contours of the surface to which it is applied. The filament diameter is 0.0003 inches with a Young's Modulus of approximately $32 \times 10^6$ psi and a tensile strength of 260,000 psi.

Figure 6B:
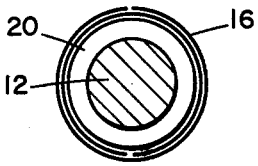
FIG. 6*b* illustrates the partially completed outer wrap.
Figure 7:
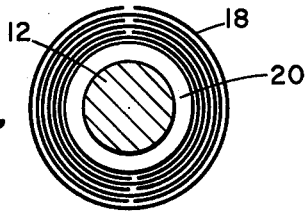
FIG. 7 shows the completed wrap.

It will be noted that in FIG. 6*b* the initial longitudinal wrap 14 has been wound onto the circumferential section 20 and is so sized that the terminus of the wrap is immediately adjacent to the starting point of the wrap. In this manner, there are no gaps or voids as the lay up continues nor are there any bumps that would produce an out of round condition. The intermediate wrap 16 illustrated in FIG. 6*b* has its starting and terminal points diametrically opposite to that of the immediately adjacent wrap 14. FIG. 7 shows the final wrap 18 on the longitudinal plies. The longitudinal plies together form a circumferential section 26 of the finished shaft as will be more apparent hereinafter.

The effect of the long shear plane provided and the interlocking effect of the interleaved radial plies 22 and 24 produces a shaft which has good torsion balance. That is, the resistance to twist in the plus direction is substantially equal to the resistance and twist in the negative direction. Since the last turn of the outermost ply 24 will have the greatest moment about the axis of the shaft, there will be a slight differential in resistance to twist favoring the direction which tends to "tighten" the outermost ply.

The balance in torsional characteristics and overall torsional strength may be further enhanced by utilizing high modulus graphite fibers for the fibers 30 in ply 22. High modulus fibers generally have a Young's Modulus of approximately $50 \times 10^6$ psi and thus, are substantially 50% more rigid than the normal fibers. However, the tensile strength is essentially inversely proportional to Young's Modulus and therefore, the tensile strength of such high modulus fibers is only 180,000 psi. If such high modulus fibers were incorporated into a single wrap, they would tend to accpet substantially all of the torsional stress as it is applied because of their high load rate. Without a good force transfer relationship to an adjacent layer, this would result in failure in tension or by separation of the fibers from the matrix material. However, when incorporated in a three-turn wrap as in the instant invention, and with a long fiber length such as is obtained with the 35° axial orientation of the fibers, there is sufficient force transfer relationship and cooperation from the adjacent interleaved layers to provide a finished shaft of high strength and integrity. The use of the high modulus fibers for the inner of the two plies in the sandwich balances the tendency for the outermost wrap to have the highest effect on torsion resistance and therefore, produces a finished shaft with the best balance of torsion characteristics.

Figure 8:
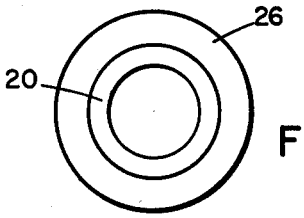
FIG. 8 is an end view of the completed shaft with the mandrel removed.

After the matrix is cured, the mandrel 12 is withdrawn from the lay up producing a finished shaft as illustrated in FIG. 8.

Having described my invention, I now claim:

1. A construction for a fiber reinforced generally cylindrical shaft comprising:
   - a first circumferential section of the thickness of said shaft comprising a plurality of radial plies forming in transverse aspect alternate interleaved wound helicies,
   - each of said helicies having more than one turn around said shaft,
   - each of said plies comprising a plurality of parallel reinforcing fibers in matrix material oriented in longitudinal aspect at a ptich angle of inclination to the longitudinal axis of said shaft at substantially 35°,
   - the fibers in alternate radial plies having pitch angles of opposite inclination, wherein the inner terminus of alternate of said radial plies are substantially diametrically opposite.

2. The construction for a fiber reinforced generally cylindrical shaft according to claim 1 wherein:
   - said radial plies wrap at least two full turns around said shaft.

3. A construction for a shaft according to claim 2 wherein:

said fibers are graphite fibers.

4. A construction for a shaft according to claim 2 wherein:

the Young's Modulus of the fibers in one radial ply is substantially greater than the Young's Modulus of the fibers in the adjacent radial ply.

5. A construction for a fiber reinforced generally cylindrical shaft comprising:

a first circumferential section of the thickness of said shaft comprising a plurality of radial plies forming in transverse aspect alternate interleaved wound helicies, each of said helicies having more than one turn around said shaft, each of said plies comprising a plurality of parallel reinforcing fibers in matrix material oriented in longitudinal aspect at a pitch angle of inclination to the longitudinal axis of said shaft in the range of 20° to 50°, the fibers in alternate radial plies having pitch angles of opposite inclination wherein the inner terminus of alternate of said radial plies are substantially diametrically opposite, said radial plies wrap at least two full turns around said shaft, the Young's Modulus of the fibers in one radial ply being substantially greater than the Young's Modulus of the fibers in the adjacent radial ply.

6. The construction for a fiber reinforced generally cylindrical shaft according to claim 5 wherein:

the Young's Modulus of the fibers in said one radial ply is substantially 50 percent greater than the Young's Modulus for the fibers in the adjacent radial ply.

* * * * *